United States Patent [19]

Wrenn, Jr. et al.

[11] Patent Number: 4,743,340

[45] Date of Patent: May 10, 1988

[54] HIGH-TEMPERATURE ZIRCONIA INSULATION AND METHOD FOR MAKING SAME

[75] Inventors: George E. Wrenn, Jr., Clinton; Cressie E. Holcombe, Jr., Knoxville; John Lewis, Jr., Oak Ridge, all of Tenn.

[73] Assignee: Martin Marietta Energy Systems Inc., Oak Ridge, Tenn.

[21] Appl. No.: 810,899

[22] Filed: Dec. 20, 1985

Related U.S. Application Data

[63] Continuation-in-part of Ser. No. 489,922, Apr. 29, 1983, abandoned.

[51] Int. Cl.[4] ..... D21H 5/18; D21J 7/00

[52] U.S. Cl. ..... 162/152; 162/157.1; 162/181.2; 162/181.5; 162/218; 162/224; 162/226; 162/228

[58] Field of Search ..... 162/152, 157.1, 181.2, 162/181.5, 218, 145, 221, 224, 228, 226, 182; 501/103, 95, 104

[56] References Cited

U.S. PATENT DOCUMENTS

| | | | |
|---|---|---|---|
| 3,100,734 | 8/1963 | Rex et al. | 162/152 |
| 3,303,033 | 2/1967 | LaGrange et al. | 501/103 |
| 3,476,641 | 11/1969 | Milewski | 162/152 |
| 3,671,385 | 6/1972 | Trent et al. | 162/152 |
| 3,704,147 | 11/1972 | Hardy et al. | 501/95 |
| 3,736,160 | 5/1973 | Hamling | 501/103 |
| 3,935,060 | 1/1976 | Blome et al. | 162/152 |
| 3,996,145 | 12/1976 | Hepburn | 501/103 |
| 4,219,359 | 8/1980 | Miwa et al. | 501/104 |
| 4,344,904 | 8/1982 | Yamada et al. | 501/104 |
| 4,354,900 | 10/1982 | Bailey et al. | 162/152 |
| 4,360,598 | 11/1982 | Otagiri et al. | 501/103 |
| 4,612,087 | 9/1986 | Teweyck | 162/131 |

FOREIGN PATENT DOCUMENTS

| | | | |
|---|---|---|---|
| 2021964 | 11/1970 | Fed. Rep. of Germany | 162/157.1 |
| 2127418 | 1/1973 | Fed. Rep. of Germany | 162/152 |
| 435213 | 11/1974 | U.S.S.R. | 501/103 |

OTHER PUBLICATIONS

Battista, *Synthetic Fibers in Papermaking*, (1964) pp. 198, 215–221.

*Primary Examiner*—Peter Chin

*Attorney, Agent, or Firm*—Herman L. Holsopple; Bruce M. Winchell

[57] ABSTRACT

The present invention is directed to a highly pure, partially stabilized, fibrous zirconia composite for use as thermal insulation in environments where temperatures up to about 2000° C. are utilized. The composite of the present invention is fabricated into any suitable configuration such as a cone, cylinder, dome or the like by vacuum molding an aqueous slurry of partially stabilized zirconia fibers into a desired configuration on a suitably shaped mandrel. The molded fibers are infiltrated with zirconyl nitrate and the resulting structure is then dried to form a rigid structure which may be removed and placed in a furnace. The structure is then heated in air to a temperature of about 600° C. for driving off the nitrate from the structure and for oxidizing the zirconyl ion to zirconia. Thereafter, the structure is heated to about 950° to 1,250° C. to fuse the zirconia fibers at their nexi in a matrix of zirconia. The composite produced by the present invention is self-supporting and can be readily machined to desired final dimensions. Additional heating to about 1800° to 2000° C. further improves structural rigidity.

5 Claims, No Drawings

HIGH-TEMPERATURE ZIRCONIA INSULATION AND METHOD FOR MAKING SAME

The present invention was made under contract W-7405-ENG-26 between Union Carbide Corporation and the U.S. Department of Energy.

This is a Continuation-In-Part of application Ser. No. 489,922 filed Apr. 29,1983 now abandoned.

BACKGROUND OF THE INVENTION

The present invention is directed to the fabrication of thermal insulation of selected configurations from zirconia fibers, and more particularly to such a thermal insulation wherein the zirconia fibers are joined in a matrix of zirconia at their nexi to form a rigid configured structure.

Furnaces for various metallurgical procedures require operating temperatures up to about 2,000° C. Such high furnace temperatures require the use of a thermal insulation which possess several properties not commonly found in most thermal insulations. For example, the insulation must be capable of withstanding the high furnace temperatures without degradation while protecting furnace components from the intense heat.

A thermal insulation found satisfactory for use in such high temperature furnaces is formed of yttria stabilized zirconia fibers which possess an extremely high melting point exceeded only by oxides of hafnium and thorium. Efforts to utilize thermal insulation formed of zirconia fibers have been somewhat limited due to the fact that commercially available zirconia-fiber thermal insulation can not be readily shaped to fit particular configurations within the furnace and is available only in the form of flat boards or blocks of various thicknesses. These blocks or boards are somewhat friable and readily fall apart when subjected to stresses such as occur during machining and the like. Further, the fibrous zirconia insulation which is capable of use at temperatures as high as 2,000° C. must be held together in a supporting framework in order to maintain structural integrity. A configured form of zirconia fiber thermal insulation is available, but this pre-configured zirconia insulation requires the use of a silica binder for holding the zirconia fibers together. The presence of the silica forms an impurity or residue in the final structure which lowers the maximum service temperature to about 1,650° C.

Thus, there is a significant need for zirconia thermal insulation capable of withstanding 2,000° C. temperatures that is self supporting and which can be shaped into desired self-supporting configurations.

SUMMARY OF THE INVENTION

Accordingly, it is the primary aim or objective of the present invention to provide a thermal insulation consisting essentially of partially stabilized zirconia fibers and zirconia which can be shaped into any desired configuration during the manufacture thereof and which is sufficiently self supporting so as to be utilized within the furnace confines without requiring the heretofore needed support structure. The thermal insulation composite of the present invention consists essentially of partially stabilized zirconia fibers joined together at their nexi by a matrix of partially stabilized zirconia. Generally, this thermal insulating composite is fabricated by the steps comprising molding an aqueous solution of partially stabilized zirconia fibers into a desired configuration, removing excess water from the molded configuration, saturating the molded configuration of zirconia fibers with an aqueous solution of zirconyl nitrate, sufficiently drying the resulting configured shape to provide a rigid structure of the fibers joined by the zirconyl nitrate, heating the structure in air to a temperature sufficient to drive off the nitrate in the zirconyl nitrate and convert the remaining zirconyl ion to zirconia, and thereafter heating the structure to a temperature adequate to fuse the fibers at their nexi with the zirconia derived from the zirconyl nitrate to provide the self-supporting composite.

By practicing the present invention, relatively complex shapes such as domes, cylinders, cones, and the like can be fabricated from zirconia fibers so as to provide self-supporting structures of thermal insulation capable of withstanding temperatures in the order of about 2,000° C. By using partially stabilized zirconia fibers in the thermal insulation the destructive crystallographic phase transformations in the zirconia do not occur. Also, the partially stabilized zirconia acts as a thermal stress moderator because of its micro-cracking ability.

The density of the thermal insulation is in the range of about 0.80 g. $cm^{-3}$ to 0.95 g. $cm^{-3}$. The greater densities can be achieved by additional treatments of zirconyl nitrate solution to the structure prior to the final firing.

Other and further objects of the invention will be obvious upon an understanding of the illustrative method about to be described or will be indicated in the appended claims, and various advantages not referred to herein will occur to one skilled in the art upon employment of the invention in practice.

DETAILED DESCRIPTION OF THE INVENTION

The present invention is directed to the fabrication of thermal insulation which can be used in high-temperature environments up to about 2,000° C. The thermal insulation of the present invention is formed of highly pure zirconia fibers which are partially stabilized with yttria or calcia and bound at their nexi within a matrix of partially stabilized zirconia. The fibrous composite can be fabricated in any desired configuration and possesses adequate structural integrity to be self supporting. Further, the fibrous composite can be subjected to extensive machining so as to be provided with precise dimensions required for its intended use.

In practicing the present invention zirconia fibers in the size range of about 75μm to 150μm in length and 5μm to 10μm diameter are partially stabilized with an oxide selected from a suitable material such as yttria, calcia or magnesia. The partial stabilizing of the zirconia fibers is provided by stabilizing the zirconia with about 6 to 10 wt.% yttria, about 5 to 8 wt.% of calcia. The zirconia would be fully stabilized with a yttria content greater than about 10%, a calcia or about 3 to 6 wt.% magnesia content greater than about 8 wt.% or a magnesia content greater than about 6 wt.%. Other stabilizing agents for zirconia are described in the publication "Zirconium", Metallurgy of the Rare Metals-2, by G. L. Miller, 2nd Ed., published by the Academic Press, Inc., New York, N.Y. and by the Butterworths Scientific Publications, London, Englan, (1957)pp. 26 and 27. The relevant pages of this publication are incorporated herein by reference. Partially stabilized zirconia is necessary in the practice of the present invention since the partially stabilized zirconia is a thermal stress moderator due to its micro-cracking ability which renders the insulation capable of withstanding repeated temperature cycles.

The partially stabilized zirconia fibers are molded or shaped into a desired composite configuration in any suitable manner, preferably by vacuum molding. Generally, in a vacuum molding operation the partially stabilized zirconia fibers are admixed with an excess of water and then spread as a slurry over a perforated mandrel of the desired composite configuration that is coupled to a source of vacuum. During the course of this vacuum loading, the zirconia fibers preferentially orient in planes generally parallel to the mandrel surface. Excess water is removed from the molded fiber configuration by vacuum drawing the water through the mandrel. The mandrel is preferably covered with a relatively impervious material such as a cotton cloth so as to prevent the fibers from being pulled through perforations in the mandrel.

When the excess water has been vacuumed or otherwise removed from the molded configuration the latter is saturated with an aqueous solution of zirconyl nitrate. The vacuum is utilized to assure that the zirconyl nitrate saturates the entire thickness of the molded fibers. The volume of zirconyl nitrate utilized is at least that required to provide the necessary bonding or joining of the zirconia fibers. It has been found that at least about 0.30 gm of zirconia in the form of zirconyl nitrate per gram of zirconia fibers is required for forming a rigid composite capable of being machined and which is self supporting in its intended application. The infiltration of the zirconyl nitrate into the molded fiber structure is necessary for the fabrication of the strong rigid structures, since the zirconyl nitrate effects partial dissolution of the zirconia fibers so as to facilitate the bonding of the fibers at their nexi by the zirconia in the zirconyl nitrate. The dissolved portion of the fibers also transfers a portion of the stabilizing agent to the zirconyl nitrate so as to provide a final composite in which both zirconia fibers and zirconia are partially stabilized. Additional stabilizing agent may be added to the zirconyl nitrate prior to infiltration into the molded fibrous structure for the direct stabilization of the zirconyl nitrate.

Zirconyl nitrate has been found to be the zirconium compound capable of providing the features of the present invention. Composites of zirconia fibers have been formed by using zirconyl halogens or zirconyl sulfate in place of the zirconyl nitrate, but it has been found that the halide and sulfide residues remain in the composite after the heating operation so as to significantly detract from the use of the insulation in high-temperature applications. Also, zirconyl acids such as the zirconyl sulfate and zirconyl halogens form cements with water so that the time for vacuum forming the composites is virtually eliminated by the hardening or setting time of the particular zirconyl acid.

After the zirconia fibers are permeated with the zirconyl nitrate the structure is heated in air to a temperature in the range of about 50° to 80° C. for drying the structure which set or hardens the zirconyl nitrate to a level sufficient for bonding the fibers into a rigid self-supporting structure. The dried structure is then removed from the mandrel and subjected to a heating operation for driving the nitrate from the zirconyl ion. This heating operation is achieved in air at a temperature in the range of about 500° to 600° C. for a duration of about 4 to 6 hours so that the zirconyl ion remaining after the nitrate is driven off is converted or oxidized to zirconia.

Upon completing the removal of the nitrate the composite is subjected to a final fusing or heat treatment operation at a temperature in the range of about 950° to 1,250° C. in air for a duration in the range of about 20 to 30 hours. Also, during this heating step the portion of the zirconia derived from the zirconyl nitrate that is located at the nexi of the fibers provides a cement or bonding agent for joining together the fibers. During this heat treatment or fusing step the zirconia fibers become hardened so as to provide a final product of sufficient structural integrity to retain its shape in the invisioned applications. These times and temperatures correspond to cycles used with relatively large structures.

Additional heat treatment to a temperature in the range of about 1,800° C. to 2,000° C. is recommended for structures with thicknesses over 4 cm. This treatment, is held for a duration of about 1 to 4 hours to provide additional rigidity of the structure. Further, when this heating step is completed, machining or otherwise finishing the composite to final dimensions may be readily accomplished without deleteriously damaging the fiberous composite.

The density of the fibrous composite may be regulated over a fairly wide range by impregnating the fiberous structure with zirconyl nitrate after the initial drying step or by adding zirconia powder to the initial slurry of the partially stabilized zirconia fibers.

The final fibrous composite is composed of the zirconia fibers partially stabilized with yttria or calcia in a matrix of zirconia at the nexi of the fibers. This matrix of zirconia is also partially stabilized with yttria or calcia. The resulting structure is essentially a single oxide free from additional phases except those provided by the presence of the stabilizing agent. The structure can be used in any thermal insulation application without encountering the infusion of contaminants or other unwanted material from the composite at temperatures up to about 2,000° C.

In a typical molding operation for small structures, a fibrous composites was formed in the shape of a dome. In the preparation of the dome a quantity of zirconia fibers partially stabilized with 8 wt.% yttria was slurried with water. For each 100 grams of zirconia fibers 20 gallons of water was utilized for forming the slurry. This aqueous mixture of water and zirconia fibers was then applied to a dome-shaped mandrel covered with a cotton cloth. A vacuum in the range of about 20 to 25 inches of mercury was applied into the center of the mandrel for pulling the water through the mandrel and for molding the fibers in the shape of a dome. After complete evacuation of excess water through the mandrel the vacuum was reduced to about 5 inches of mercury.

An additional cotton filter cloth soaked in water was placed over the molded composite and 300 milliliters of zirconyl nitrate solution was filtrated into the fibrous shape with the vacuum of about 5 inches of mercury. After completing the infiltration of the fibrous composite the zirconyl nitrate was dried on the mandrel in a convection oven at 50° C. for 16 hours. The dried configuration was then removed from the oven and separated from the mandrel. The resulting hard self-supporting configuration was then placed in a furnace with an air environment for driving off of the nitrate in the zirconyl nitrate and for oxidizing the zirconium ion. The temperature of the furnace was increased at a rate of about 150° to 250° C. per hour to 1,000° C. where the temperature was maintained for 18 hours. The nitrate was driven from the composite and a bond of zirconia was formed at the nexi of the fiber during this heating operation. Thereafter, the temperature of the furnace was increased to about 1,800° at a rate ranging from about 150° to 250° C. per hour and then held for a period of 1 hour. During this final heating step, the zirconia structure hardened and its surface was no longer friable or deformable.

The thermal insulating composite of the present invention can be fabricated into any shape or size and of any thickness required of the particular use. The stabilizing agent prevents destructive crystallographic phase transformations in the zirconia fibers. In the partially stabilized zirconia a portion of the grain structure is stabilized in the cubic phase while the remainder of the grain structure is changing from cubic to monoclinic phase and vice versa. Therefore, the composite is only subjected to micro-cracking during temperature cycling. Conversely, the zirconia would be subjected to deleterious cracking without the addition of the stabilizing agent. The formation of these micro-cracks during thermal cycling is particularly useful for releasing thermal stresses created during such cycling.

It will be seen that the present invention provides a thermal insulation which can be fabricated into any desired shape or density and which affords high temperature usage in various metallurgical furnaces where temperatures in the order of about 2,000° C. are required. The composite is of high purity so as to prevent the infusion of the impurities into the furnace environment during the high-temperature furnacing applications.

What is claimed is:

1. A method for fabricating a porous thermal insulting self-supporting composite structure comprising the steps of:

a. partially stabilizing zirconia fibers with a stabilizing agent selected from the group consisting of yttria, calcia and magnesia in a way such that the grain structure of zirconia fiber is maintained in the cubic phase thereby preventing destructive crystallographic phase transformations;

b. vacuum molding an aqueous slurry of the zirconia fibers over a perforated mandrel to form a structure of the desired configuration;

c. removing excess water from the zirconia molded fiber structure;

d. saturating the molded structure of zirconia fibers with an aqueous solution of zirconyl nitrate in an amount equivalent to at least 0.30 gram of zirconia per gram of zirconia fiber;

e. heating the zirconyl nitrate saturated molded structure to temperatures sufficient to set the zirconyl nitrate, to drive off the nitrate portion of the molecule, and to convert the remaining zirconyl ion to zirconia;

f. removing the mandrel, and g. thereafter, heating the zirconyl nitrate bonded molded fiber structure to a temperature adequate to fuse the fibers at the nexi thereof throughout the body of the structure with the zirconia derived from the zirconyl nitrate composite structure consisting essentially of a single oxide free from additional phases.

2. The method of claim 1 wherein the molded structure at step (b) is heated to a temperature rante of 50° to 80° C. to set the zirconyl nitrate, further heating said molded structure at a temperature range of 500° to 600° C. maintained for 4–6 hours for driving off the nitrate ion, and heating said molded structure at step (g) of claim 1 to a temperature range of 950° to 1250° C. maintained for 20–30 hours to bond the ziroconia fibers at their nexi with zirconia derived from the zirconyl nitrate.

3. The method of claim 1, wherein the yttria stabilizing agent is in a concentration of about 6 to 10 wt. %, wherein the cacia being in a concentration of about 5 to 8 wt. %, and wherein the magnesia being in a concentration of about 3 to 6 wt. %.

4. The method of claim 3 including the additional step of adding one of said stabilizing agents to the zirconyl nitrate prior to saturating the molded structure with the aqueous solution zirconyl nitrate.

5. The herein decribed thermal insulating self-supporting composite structure obtained by the method claim 1.

* * * * *